US011680449B2

(12) United States Patent
Atkins et al.

(10) Patent No.: US 11,680,449 B2
(45) Date of Patent: Jun. 20, 2023

(54) POLYCRYSTALLINE DIAMOND COMPACT WITH INCREASED LEACHING SURFACE AREA AND METHOD OF LEACHING A POLYCRYSTALLINE DIAMOND COMPACT

(71) Applicant: Halliburton Energy Services, Inc., Houston, TX (US)

(72) Inventors: William Brian Atkins, Houston, TX (US); Gagan Saini, The Woodlands, TX (US); Grant O. Cook, III, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 852 days.

(21) Appl. No.: 16/338,907

(22) PCT Filed: Nov. 2, 2016

(86) PCT No.: PCT/US2016/060063

§ 371 (c)(1),
(2) Date: Apr. 2, 2019

(87) PCT Pub. No.: WO2018/084839

PCT Pub. Date: May 11, 2018

(65) Prior Publication Data

US 2020/0040662 A1 Feb. 6, 2020

(51) Int. Cl.
*E21B 10/567* (2006.01)
*E21B 10/573* (2006.01)
(Continued)

(52) U.S. Cl.
CPC ..... *E21B 10/5673* (2013.01); *B22F 3/24* (2013.01); *B22F 7/06* (2013.01); *C22C 26/00* (2013.01);
(Continued)

(58) Field of Classification Search
CPC ..... E21B 10/46; E21B 10/55; E21B 10/5735
See application file for complete search history.

(56) References Cited

U.S. PATENT DOCUMENTS 5,054,246 A 10/1991 Phaal et al.
8,316,969 B1 * 11/2012 Bertagnolli ..... B01J 3/062 175/428
(Continued)

FOREIGN PATENT DOCUMENTS

GB 2465175 12/2010
JP 2010-516488 5/2010
KR 10-2008-0039491 5/2008

OTHER PUBLICATIONS

Examiner's Letter, Canadian Patent Application No. 3,037,846, dated Nov. 26, 2019, 5 pages.
(Continued)

*Primary Examiner* — Pegah Parvini

(74) *Attorney, Agent, or Firm* — Michael Jenney; C. Tumey Law Group PLLC

(57) ABSTRACT

The present disclosure provides a sintering assembly and a polycrystalline diamond compact (PDC) including a acid-labile leach-enhancing material, a PDC including cavities formed by removal of an acid-labile leach-enhancing material, and a method of forming a leached PDC using an acid-labile leach-enhancing material. The present disclosure further includes drill bits using PDCs formed suing an acid-labile leach-enhancing material.

19 Claims, 11 Drawing Sheets

(51) Int. Cl.

| | |
|---|---|
| ***E21B 10/55*** | (2006.01) |
| ***E21B 10/46*** | (2006.01) |
| ***B22F 3/24*** | (2006.01) |
| ***B22F 7/06*** | (2006.01) |
| ***C22C 26/00*** | (2006.01) |

(52) U.S. Cl.
CPC .... *E21B 10/5735* (2013.01); *B22F 2003/244* (2013.01); *B22F 2998/10* (2013.01); *B22F 2999/00* (2013.01); *E21B 10/46* (2013.01); *E21B 10/55* (2013.01)

(56) References Cited

U.S. PATENT DOCUMENTS

| | | | | |
|---|---|---|---|---|
| 8,328,891 | B2 | 12/2012 | Zhang et al. | |
| 8,435,317 | B2 | 5/2013 | Burgess et al. | |
| 8,470,060 | B2 | 6/2013 | Griffo et al. | |
| 8,535,400 | B2 | 9/2013 | Belnap et al. | |
| 8,679,206 | B2 | 3/2014 | Wan | |
| 2007/0169419 | A1 | 7/2007 | Davis et al. | |
| 2009/0313908 | A1 | 12/2009 | Zhang et al. | |
| 2011/0024201 | A1* | 2/2011 | Scott | E21B 10/573 175/428 |
| 2012/0018223 | A1 | 1/2012 | Setlur et al. | |
| 2012/0048626 | A1* | 3/2012 | Bellin | E21B 10/5735 175/430 |
| 2013/0068540 | A1* | 3/2013 | DiGiovanni | E21B 10/567 51/306 |
| 2013/0340352 | A1 | 12/2013 | Eve | |
| 2014/0013671 | A1 | 1/2014 | Belnap et al. | |
| 2014/0123565 | A1 | 5/2014 | Zhan et al. | |
| 2014/0165475 | A1 | 6/2014 | Lund | |
| 2015/0027787 | A1 | 1/2015 | Scott et al. | |
| 2016/0016291 | A1* | 1/2016 | Westraadt | C04B 35/52 51/297 |

OTHER PUBLICATIONS

International Search Report received for PCT Patent Application No. PCT/US2016/060063, dated Jul. 13, 2017; 16 pages.

* cited by examiner

POLYCRYSTALLINE DIAMOND COMPACT WITH INCREASED LEACHING SURFACE AREA AND METHOD OF LEACHING A POLYCRYSTALLINE DIAMOND COMPACT

RELATED APPLICATIONS

This application is a U.S. National Stage Application of International Application No. PCT/US2016/060063 filed Nov. 2, 2016, which designates the United States, and is incorporated herein by reference in its entirety.

TECHNICAL FIELD

The current disclosure relates to a polycrystalline diamond compact (PDC), such as a cutter in an earth-boring drill bit.

BACKGROUND

Components of various industrial devices are often subjected to extreme conditions, such as high temperatures and high impact contact with hard and/or abrasive surfaces. For example, extreme temperatures and pressures are commonly encountered during drilling for oil extraction or mining purposes. Diamond, with its unsurpassed mechanical properties, can be the most effective material when properly used in a cutting element or abrasion-resistant contact element for use in drilling. Diamond is exceptionally hard, conducts heat away from the point of contact with the abrasive surface, and may provide other benefits in such conditions.

Diamond in a polycrystalline form has added toughness as compared to single-crystal diamond due to the random distribution of the diamond crystals, which avoids particular planes of cleavage from traversing the whole diamond thickness, such as, can be found in single-crystal diamond. Therefore, polycrystalline diamond is frequently the preferred form of diamond in many drilling applications. A drill bit cutting element that utilizes polycrystalline diamond is commonly referred to as a polycrystalline diamond compact (PDC) cutter. Accordingly, a drill bit incorporating PDC cutters may be referred to as a PDC bit.

PDCs can be manufactured in a cubic, belt, or other press by subjecting small grains of diamond and other starting materials to ultrahigh pressure and temperature conditions. One PDC manufacturing process involves forming a polycrystalline diamond table directly onto a substrate, such as a tungsten carbide substrate. The process involves placing a substrate containing a sintering aid, such as cobalt (Co), along with loose diamond grains mixed into a container of a press, and subjecting the contents of the press to a high-temperature high-pressure (HTHP) press cycle. The high temperature and pressure cause the small diamond grains to form into an integral polycrystalline diamond table intimately bonded to the substrate, with Co acting as sintering aid to promote the formation of new diamond-diamond bonds.

Although useful in creating the polycrystalline diamond table, sintering aids, such as Co, typically have a coefficient of thermal expansion (CTE), both linear and volumetric, significantly higher than that of diamond, such that, when the PDC heats up during use, remaining sintering aid material within polycrystalline diamond (PCD) expands more rapidly or to a greater degree than the diamond, sometimes causing cracks/micro cracks or otherwise modifying residual stresses within the diamond grains. A polycrystalline diamond table may be leached to remove at least a portion of the sintering aid. The resulting leached PDC is more thermally stable than a similar, non-leached PDC. The resulting leached PDC is more thermally stable than a similar, non-leached PDC. Leached PDCs typically have at least 85% of the sintering aid removed. Leached PDCs may be leached to a given depth from the polycrystalline diamond outer surface, which is generally referred to as the leaching depth. The PDC may contain non-leached polycrystalline diamond, typically at a greater depth, for example, closer to the interface between the diamond table and the substrate.

Leaching large portions, or substantially all, of the sintering aid results in a thermally stable polycrystalline (TSP) diamond table. At a certain temperature, typically at least 750° C. at normal atmospheric pressure, the TSP cutters will not crack or graphitize, but non-leached PDCs will crack or graphitize under similar conditions. TSP diamond may be formed to a given leaching depth, or an entire diamond table may be TSP.

BRIEF DESCRIPTION OF THE DRAWINGS

A more complete understanding of the present embodiments and advantages thereof may be acquired by referring to the following description taken in conjunction with the accompanying drawings, which show particular embodiments of the current disclosure, in which like numbers refer to similar components, and in which:

FIG. 8 is a series of not-to-scale, cross-sectional diagrams of various shapes of acid-labile leach-enhancing material in which:

DETAILED DESCRIPTION

The present disclosure relates to unleached PDCs with an acid-labile leach-enhancing material included in the polycrystalline diamond table. This acid-labile leach-enhancing material may be removed prior to or during leaching to increase the surface area of the polycrystalline diamond table available for further leaching. The present disclosure also includes leached PDCs containing cavities where acid-labile leach-enhancing material was located, or backfill material in such cavities. The present disclosure further provides methods of leaching the polycrystalline diamond table of a PDC using increased leaching surface area made available by removing acid-labile leach-enhancing material to leave cavities in the polycrystalline diamond table.

FIG. 1 is a series of cross-sectional schematic views of a sintering assembly used to form a PDC cutter with acid-labile leach-enhancing material through sintering, the PDC cutter with acid-labile leach-enhancing material, and the PDC cutter after removal of the acid-labile leach-enhancing material and after leaching and backfilling.

Figure 1A:
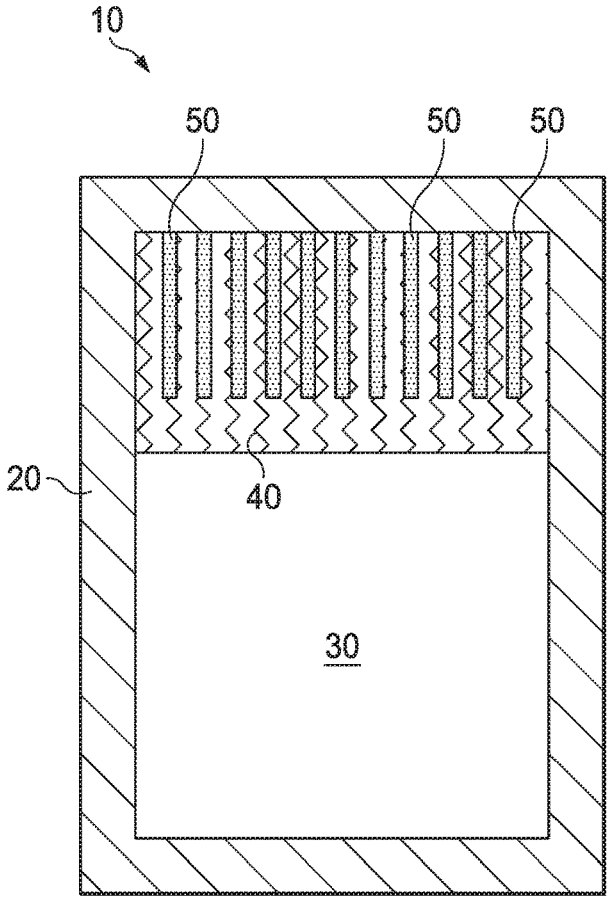
FIG. 1A is a not-to-scale, cross-sectional schematic diagram of a sintering assembly for a PDC cutter with an acid-labile leach-enhancing material.
Figure 1B:
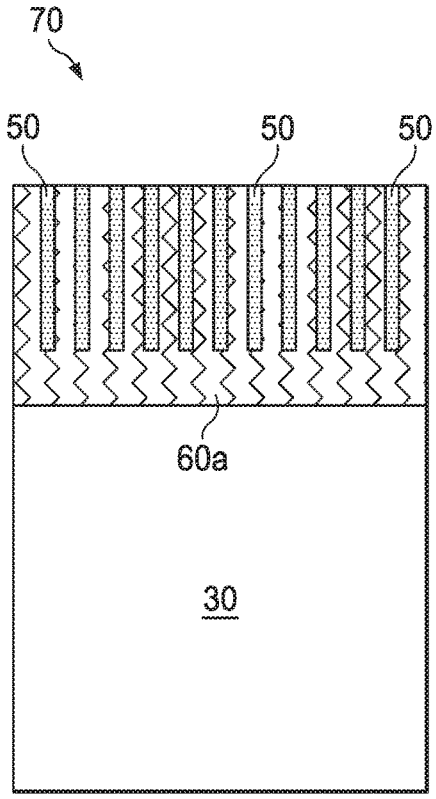
FIG. 1B is a not-to-scale, cross-sectional schematic diagram of a sintered PDC cutter with an acid-labile leach-enhancing material formed using the assembly of FIG. 1A.

Referring to FIG. 1A, sintering assembly 10 includes can 20 containing substrate 30, diamond grains 40, and acid-labile leach-enhancing material 50. Sintering in a HTHP process results in sintered PDC cutter 70, as shown in FIG. 1B, that contains acid-labile leach-enhancing material 50 in unleached polycrystalline diamond table 60*a*. Unleached polycrystalline diamond table 60*a* is bound to substrate 30.

Figure 1C:
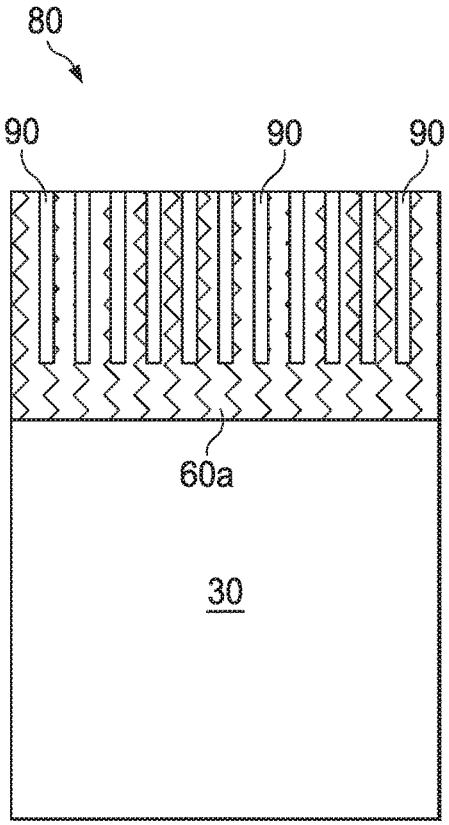
FIG. 1C is a not-to-scale, cross-sectional schematic diagram of a sintered PDC cutter with increased leaching surface area formed by removal of acid-labile leach-enhancing material from the PDC cutter of FIG. 1B.
Figure 1D:
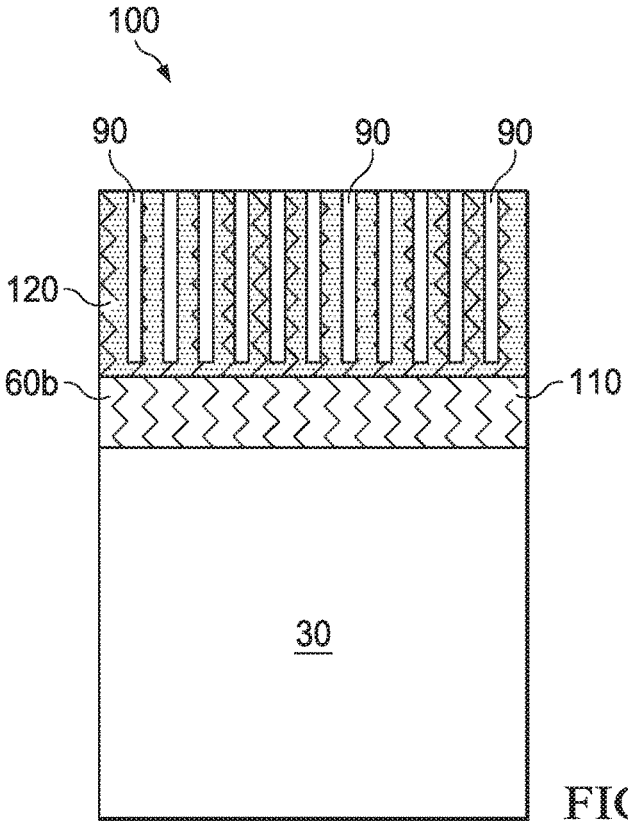
FIG. 1D is a not-to-scale, cross-sectional schematic diagram of a leached PDC cutter formed by leaching the sintered PDC cutter with increased leaching surface area of FIG. 1C.

In FIG. 1C, the acid-labile leach-enhancing material 50 has been removed, resulting in cavities 90 in unleached polycrystalline diamond table 60*a*. This produces sintered PDC cutter 80 with increased leaching surface area formed by the walls of cavities 90. Leaching then results in leached PDC cutter 100 as shown in FIG. 1D. Leached polycrystalline diamond table 60*b* in leached PDC cutter 100 may have both an unleached region 110, typically adjacent substrate 30, and leached region 120 surrounding cavities 90 and typically on the opposite side of the polycrystalline diamond table from substrate 30. As compared to a PDC with no acid-labile leach-enhancing material, the volume of the unleached region 110 will be smaller in the PDC shown in FIG. 1 and which utilizes acid-labile leach-enhancing material.

Figure 1E:
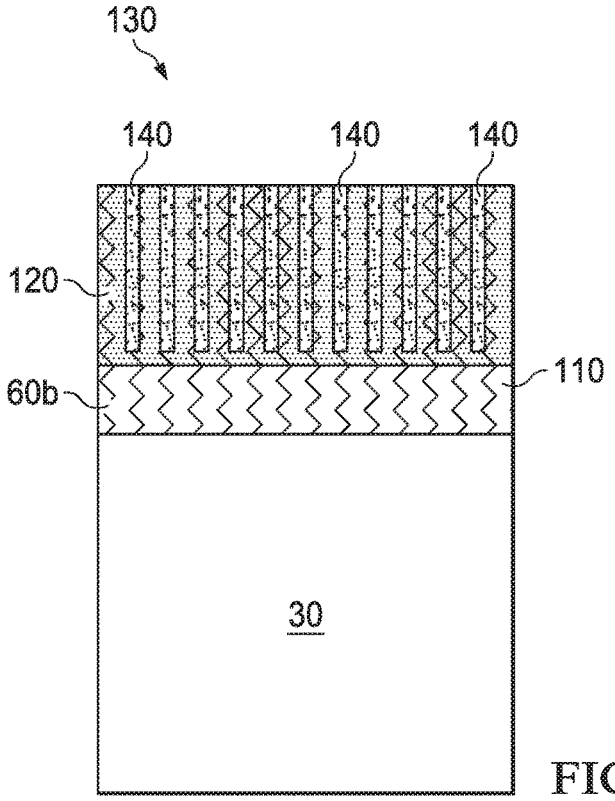
FIG. 1E is a not-to-scale, cross-sectional schematic diagram of a backfilled PDC cutter formed by adding a backfill material to the leached PDC cutter of FIG. 1D.

Leached PDC cutter 100 may be used without further treatment. However, cavities 90 may also be wholly or partially filed with a backfill material 140 to result in backfilled PDC cutter 130, as shown in FIG. 1E. Backfill material may include silicon (Si) or a carbide-forming element, such as tungsten (W). Backfilling may increase the impact toughness or other mechanical properties of backfilled PDC cutter 130 as compared to leached PDC cutter 100.

Substrate 30 may be any substrate suitable for use in a PDC cutter. In particular, it may be a conventional substrate, such as a tungsten carbide substrate. Substrate 30 may include a sintering aid that catalyzes the formation of diamond-diamond bonds, allowing diamond grains 40 to form polycrystalline diamond table 60 in the HTHP process. The sintering aid may also be located with diamond grains 40, both in substrate 30 and diamond grains 40, or in any other location that allows it to catalyze the formation of diamond-diamond bonds during the HTHP process. The sintering aid may also assist in bonding diamond table 60 to substrate 30 and in forming substrate 30 if it is not in final form before the HTHP process. Any one or combination of sintering aids may be used. Suitable sintering aids include Group VIII metals, such as Co, nickel (Ni), iron (Fe), or copper (Cu), and their alloys.

Diamond grains 40 may be any suitable diamond grains, including diamond grains of substantially uniform grain sizes, diamond grains of mixed grain sizes, or mixtures thereof located in different areas of what will become polycrystalline diamond table 60 after it is formed.

Acid-labile leach-enhancing material 50 may be any material that is able to remain at least partially intact during the HTHP process and then be dissolved by acid more readily than at least one sintering aid because it is more acid-labile in the acid than the sintering aid. The purpose of acid-labile leach-enhancing material 50 is to be removed by acid prior to or during leaching, thereby forming cavities 90, which provide greater surface area of polycrystalline diamond table 90 in contact with a leaching fluid. Accordingly, acid-labile leach-enhancing material 50 may be dissolved by acid more readily than all sintering aids, when more than one sintering aid is present, because it is more acid-labile in the acid than any of the sintering aids.

Suitable acid-labile leach-enhancing materials 50 include W, halfnium (Hf), and vanadium (V), metal-coated W, Hf, or V, such as Ni or Co-coated W, Hf, or V, and other metals or alloys, ceramics, and glasses.

In order to remain at least partially intact during the HTHP process, suitable acid-labile leach-enhancing materials 50 may have limited ability to dissolve into or otherwise enter diamond grains 40 during an HTHP process. They may also be able to retain their general shape during such a process. Thus, at least a portion of the acid-labile leach-enhancing material 50 will typically have a melting point above the temperature of the HTHP process. Acid-labile leach-enhancing materials 50 may have sufficient ductility to cause them to elongate during an HTHP process, thereby further increasing leaching surface area provided by cavities 90.

Acid-labile leach-enhancing materials 50 may be removed by a pre-leaching acid prior to leaching polycrystalline diamond table 60. A pre-leaching acid may be able to remove at least 80 wt %, at least 90 wt %, at least 95 wt %, or at least 99 wt % of acid-labile leach-enhancing materials 50 when incubated at 20° C. for 1 day. The pre-leaching acid may also remove no more than 10 wt % of the sintering aid from polycrystalline diamond table 60*a* when incubated at 20° C. for 1 day, although in most instances, removal of sintering aid during pre-leaching is not a problem and may actually be a benefit, such that it is not a concern of more than 10 wt % sintering aid is removed by the pre-leaching acid.

Hydrofluoric acid (HF) is an example of one suitable pre-leaching acid for use with a W-containing acid-labile leach-enhancing material 50.

Leaching may then be conducted with any suitable leaching agent able to dissolve at least one sintering aid and remove it from polycrystalline diamond table 60. For instance, nitric and sulfuric acids and mixtures thereof are often used as the leaching agent for Co and Co-based sintering aids. Leached agents enter polycrystalline diamond via a surface in contact with the leaching agent and leached sintering aid exits with such a surface. The surface area of a polycrystalline diamond table available to contact the leaching agent may be referred to as the leaching surface area. Cavities 90 increase the leaching surface area of polycrystalline diamond table 60. In particular, cavities 90 increase the leaching surface area inside polycrystalline diamond table 60.

In FIG. 1D and FIG. 1E, leached polycrystalline diamond table 60*b* refers to any polycrystalline diamond table that has had sintering agent removed by a leaching agent. Although FIG. 1D and FIG. 1E depict a distinct leached portion 120 and unleached portion 110 of leached polycrystalline diamond table 60*b* with a sharp boundary between the portions, this depiction is for ease of understanding the basic concept only. Actual leached PDC cutters typically have a gradual transition from a portion where substantial amounts of sintering aid have been removed to a portion where most or all sintering aid remains.

Although FIG. 1 depicts the progression of a PDC cutter through a pre-leaching step and a separate leaching step, the leaching agent typically can also dissolve acid-labile leach-enhancing material 50, such that the pre-leaching step may be omitted. In such instances, removal of acid-labile leach-enhancing material 50 and leaching may occur concurrently, such that cavities 90 increase in size while leaching occurs.

In addition, although FIG. 1 and other figures herein depict acid-labile leach-enhancing material 50 as either wholly present or entirely absent, often some acid-labile leach-enhancing material 50 may remain in polycrystalline diamond table 60, even after leaching because it is difficult to remove all of any time of material from polycrystalline diamond table 60. In some instances, acid-labile leach-enhancing material 50 may intentionally be left in polycrystalline diamond table 60. For example, a process may be used in which some acid-labile leach-enhancing material 50 is removed and polycrystalline diamond table 60 is leached, then the leaching profile may be evaluated to determine if more acid-labile leach-enhancing material removal and leaching is needed to obtain a PDC cutter with a particular leaching profile. If further leaching is not needed, then some acid-labile leach-enhancing material 50 may be left in the PDC cutter. Such remaining material may provide mechanical strength as well as impact toughness to the PDC cutter.

Acid-labile leach-enhancing material 50 may be in the form of microstructures or nanostructures, or a mixture thereof. Microstructures generally have an average largest linear dimension of at least 1 μm and less than 1000 μm, less than 500 μm, or less than 100 μm. Nanostructures generally have an average largest linear dimension of at least 1 nm and less than 1000 nm, less than 500 nm, or less than 100 nm. Microstructures may be better able to increase leaching surface area than nanostructures, but microstructures may cause greater decreases in mechanical strength of polycrystalline diamond table 60 than do nanostructures. Due to the tendency of microstructures to decrease mechanical strength of polycrystalline diamond table 60 more than nanostructures, it may be possible to include more acid-labile leach-enhancing material 50 by overall volume when it is in the form of nanostructures. Thus, the total available leaching surface area may still be similar to that obtained using microstructures.

FIG. 1 depicts acid-labile leach-enhancing material 50 in the form of microstructures. These microstructures are oriented in a pattern among diamond grains 40 in FIG. 1A. After the HTHP process and removal of acid-labile leach-enhancing material 50, resulting cavities 90 are in a similar pattern in polycrystalline diamond table 90, as shown in FIGS. 1B-1D. In the pattern shown, each element 50 may extend into polycrystalline diamond table 60 from the adjacent surface at least 1 μm, at least 10 μm, at least 50 μm, at least 100 μm, or at least 200 μm, or another distance within 1 μm or 5 μm of the leaching depth. The leaching surface area of unleached polycrystalline diamond table 60*a* in FIG. 1C or other polycrystalline diamond tables formed using microstructures of acid-labile leach-enhancing material 50 may be at least 10% greater, at least 30% greater, or at least 50% greater than in an otherwise identical polycrystalline diamond table lacking cavities 90.

Figure 2A:
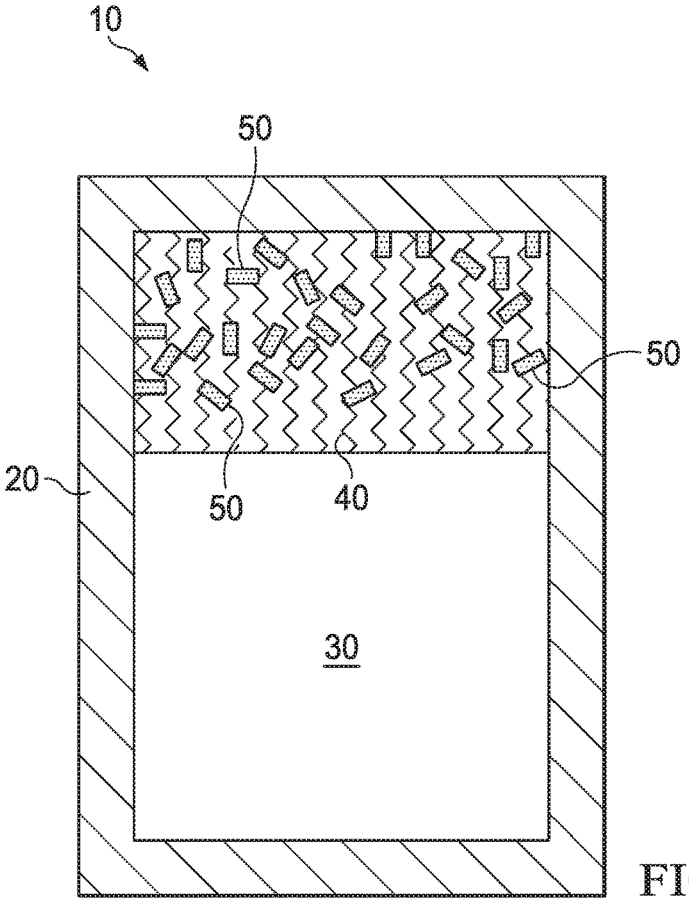
FIG. 2A is a not-to-scale, cross-sectional schematic diagram of a sintering assembly for a PDC cutter with nanostructures of an acid-labile leach-enhancing material.
Figure 2B:
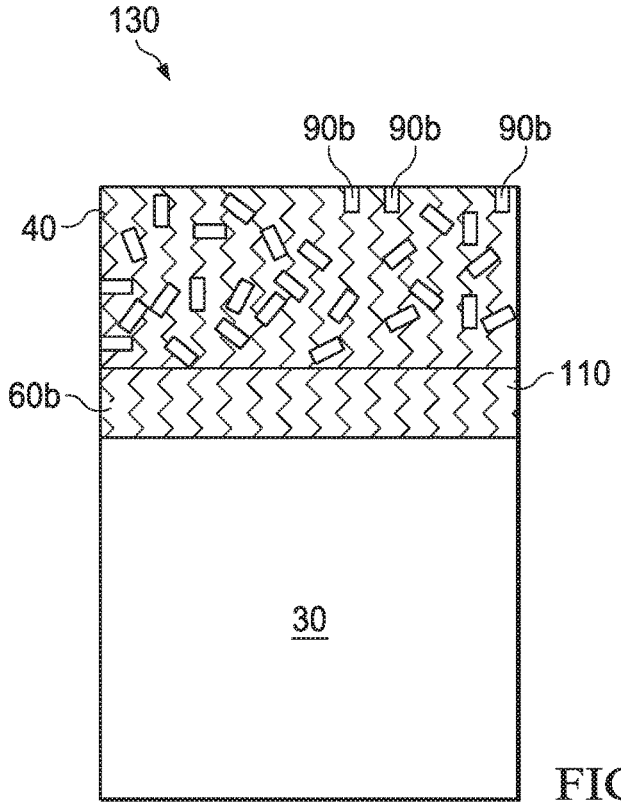
FIG. 2B is a not-to-scale, cross-sectional schematic diagram of a sintered PDC cutter with increased leaching surface area formed by removal of acid-labile leach-enhancing material from the nanostructures shown in FIG. 2A.

FIG. 2A depicts acid-labile leach-enhancing material 50 in the form of nanostructures. These nanostructures are dispersed in a portion of diamond grains 40. After the HTHP process and removal of acid-labile leach-enhancing material 50, resulting cavities 90 are in a similar portion of polycrystalline diamond table 60, as shown in FIG. 2B. That portion of polycrystalline diamond table 60 may extend from the adjacent surface at least 1 μm, at least 10 μm, at least 50 μm, at least 100 μm, or at least 200 μm, or another distance within 1 μm or 5 μm of the leaching depth. The leaching surface area of the unleached polycrystalline diamond table formed using nanostructures of acid-labile leach-enhancing material may be at least 5% greater, at least 10% greater, or at least 20% greater than in an otherwise identical polycrystalline diamond table lacking cavities.

Figure 3A:
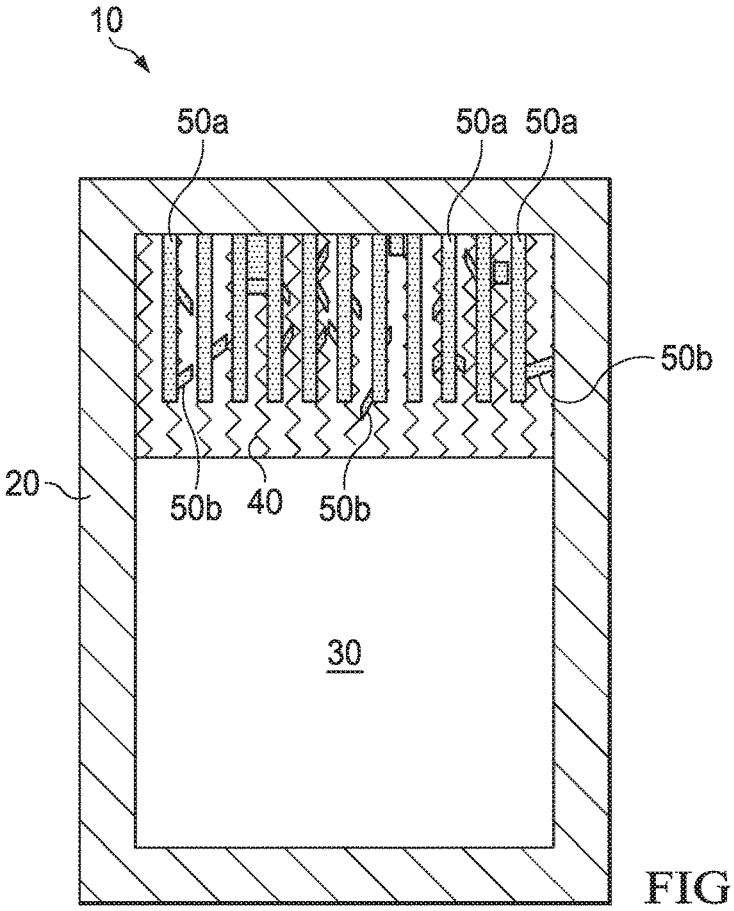
FIG. 3A is a not-to-scale, cross-sectional schematic diagram of a sintering assembly for a PDC cutter with both microstructures and nanostructures of an acid-labile leach-enhancing material.

The benefits of both microstructures and nanostructures of acid-labile leach-enhancing material 50 may be achieved by using a mixture of both. The proportions of microstructures to nanostructures by number in the mixture may be between 5:1 and 1:5, in particular between 2:1 and 1:2. FIG. 3A depicts sintering assembly 10 containing both acid-labile leach-enhancing material 50*a* in the form of microstructures and acid-labile leach-enhancing material 50*b* in the form of nanostructures. After sintering, in the PDC cutter of FIG.

3B, microstructure cavities 90*a* may allow the leaching agent to readily penetrate to a given depth from the surface of polycrystalline diamond table 60, while the nanostructure cavities 90*b* may facilitate movement of the leaching agent out from microstructure cavities 90*a*. The portion of polycrystalline diamond table 60 in which acid-labile leach-enhancing material 50 is found may extend from the adjacent surface at least 1 μm, at least 10 μm, at least 50 μm, at least 100 μm, or at least 200 μm, or another distance within 1 μm or 5 μm of the leaching depth. The leaching surface area of the unleached polycrystalline diamond table formed using a combination of microstructures and nanostructures of acid-labile leach-enhancing material may be at least 10% greater, at least 30% greater, at least 50% greater, or at least 60% greater than in an otherwise identical polycrystalline diamond table lacking cavities.

Acid-labile leach-enhancing material 50, whether in the form of microstructures, nanostructures, or a mixture, may be evenly distributed within diamond grains 40 so that cavities 90 are evenly distributed within polycrystalline diamond table 60 or a portion thereof. This even distribution may increase the mechanical stability of polycrystalline diamond table 60, particularly if cavities 90 are not back-filled.

Figure 3B:
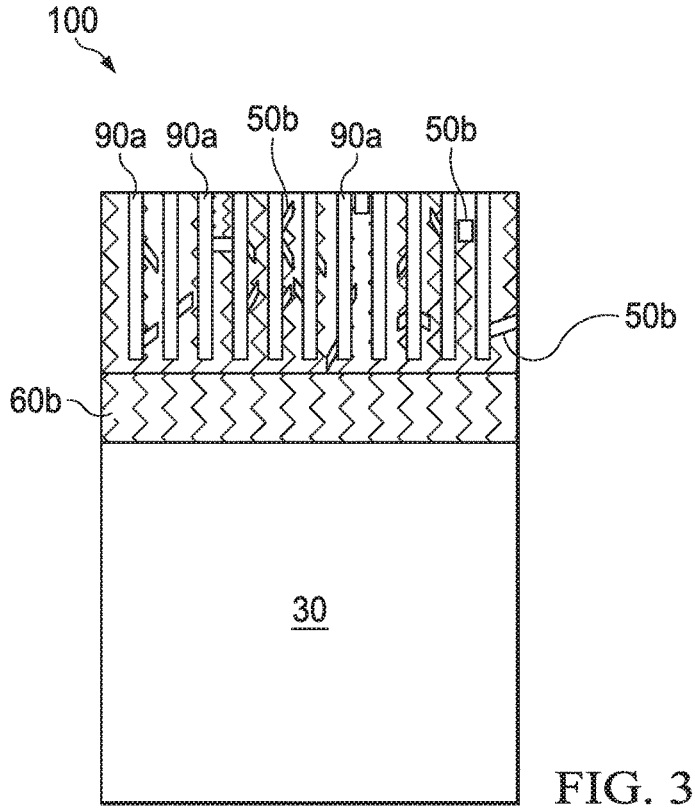
FIG. 3B is a not-to-scale, cross-sectional schematic diagram of a sintered PDC cutter with increased leaching surface area formed by removal of acid-labile leach-enhancing material from the microstructures and nanostructures shown in FIG. 3A.
Figure 4A:
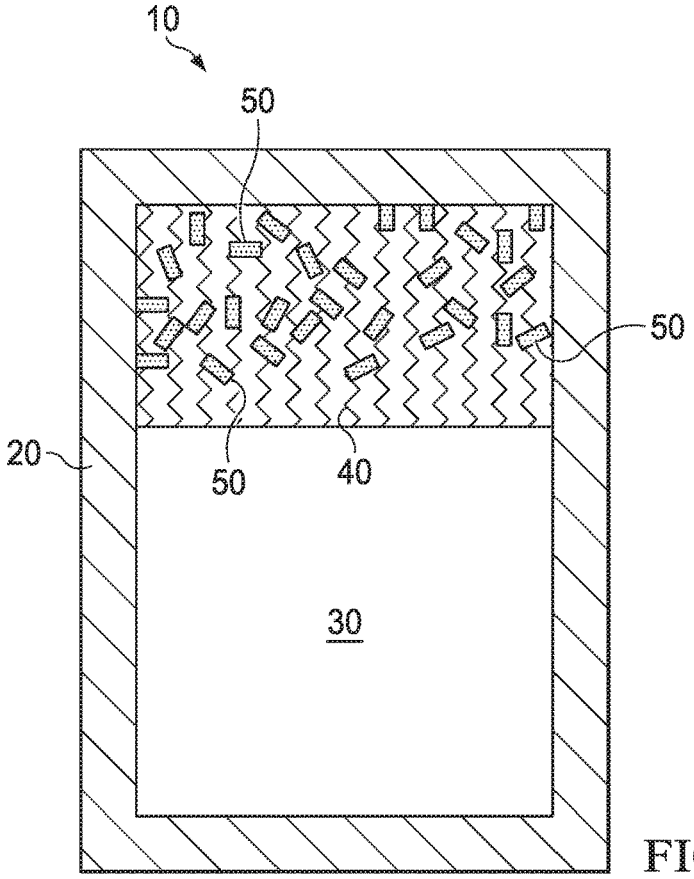
FIG. 4A is a not-so-scale, cross-sectional diagram of a sintering assembly for a PDC cutter with localized acid-labile leach-enhancing material.
Figure 4B:
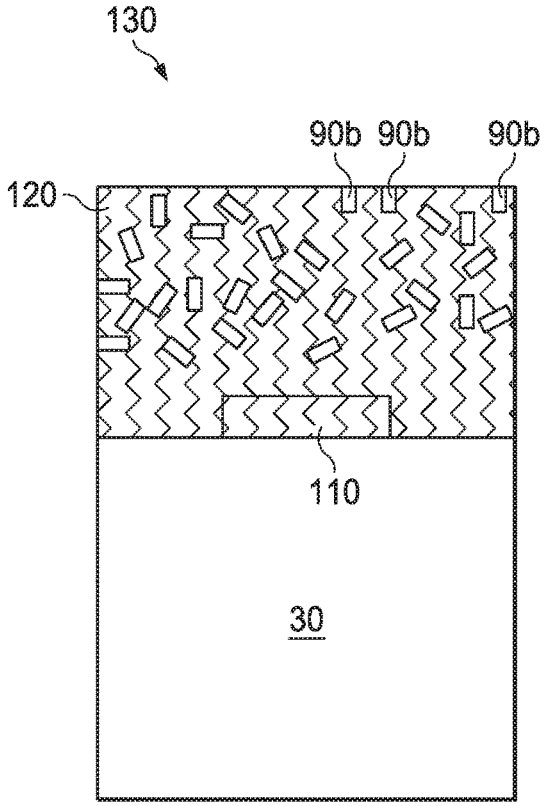
FIG. 4B is a not-to-scale, cross-sectional diagram of a leached PDC cutter formed by removal of acid-labile leach-enhancing material shown in FIG. 4A to increase the leaching surface area of the sintered PDC cutter, followed by leaching of the sintered PDC cutter.

Although FIGS. 1-3 depict acid-labile leach-enhancing material that reaches to a leaching depth from a top surface of the PDC cutter, the leaching depth may also extend from a side surface if, as depicted in FIG. 4A, acid-labile leach-enhancing material 50 is placed along the upper and side portions of diamond grains 40 in sintering assembly 10. After the HTHP process and leaching, leached polycrystalline diamond table 60*b* of FIG. 4B contains a leached portion 120 on the top and sides, and a central unleached portion 110.

Acid-labile leach-enhancing material 50 may be oriented in diamond grains 40 and subsequently in polycrystalline diamond table 60 in a particular pattern or manner. For instance, elongated microstructures of acid-labile leach-enhancing material 50, such as those of FIG. 1 may be oriented so that they extend lengthwise into polycrystalline diamond table 60 from, at, or near its surface, particularly its top surface. This allows the leaching agent to readily penetrate to a depth within polycrystalline diamond table 60 and thus readily leach to at least that depth.

In addition because fractures in the polycrystalline diamond table during PDC use tend to run along boundaries between leached and unleached regions, acid-labile leach-enhancing material 50 may be oriented in a particular pattern or manner to direct the location of such boundaries and thus the likely location of fractures, which may lead to improved PDC life.

Figure 8A:
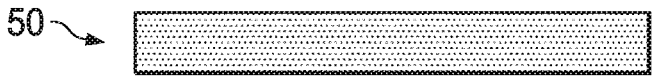
FIG. 8A is an elongated microstructure or nanostructure.
Figure 8B:
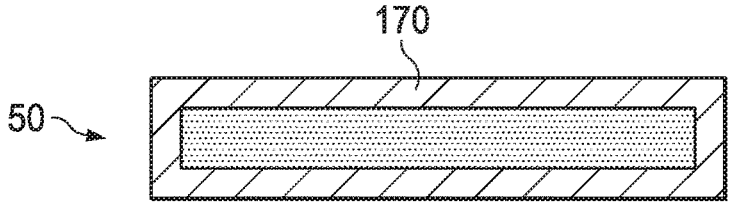
FIG. 8B is a magnetic material-coated, elongated microstructure or nanostructure.

Acid-labile leach-enhancing material 50 may be oriented using any of a variety of methods. For instance, if acid-labile leach-enhancing material 50 contains a magnetic component, such as a Co, Ni, or Fe coating on W as shown in FIG. 8B or an internal magnetic component, then a magnetic field may be used to orient the material. Acid-labile leach-enhancing material 50 may also contain a polarizable moiety, such as that shown in FIG. 8C, which allows an electric field to be used to orient it.

Acid-labile leach-enhancing material 50 may also be directed to particular regions of diamond grains 40 and ultimately polycrystalline diamond table 60 using a magnetic or electric field, or by vibrating sintering assembly 10.

Figure 5:
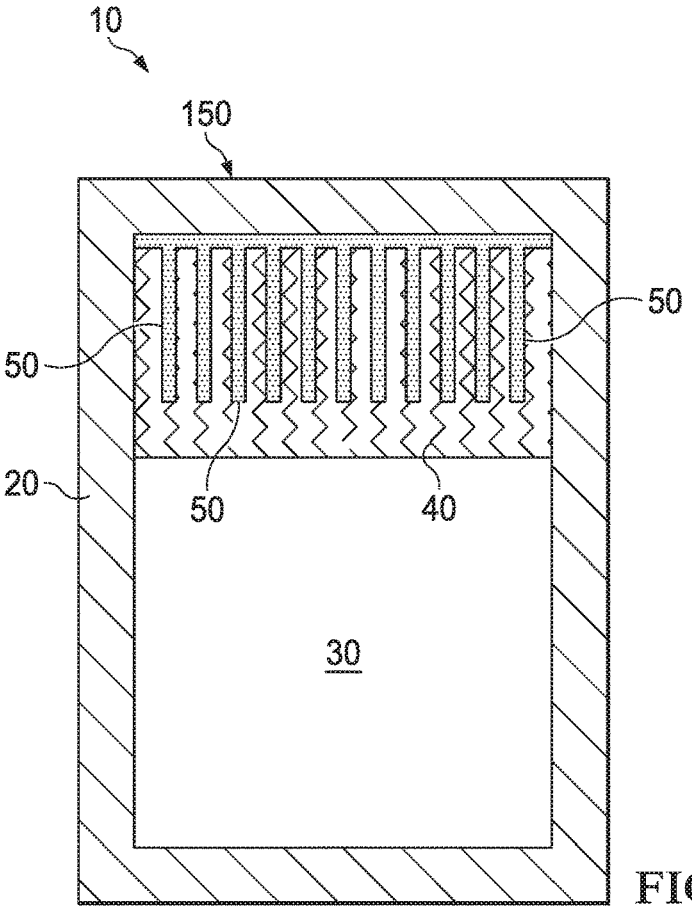
FIG. 5 is a not-to-scale, cross-sectional diagram of a sintering assembly for a PDC cutter with a surface template of acid-labile leach-enhancing material.

As shown in FIG. 5, acid-labile leach-enhancing material 50 may also be formed on a template, such as template 150. This template may be made from the acid-labile leach-enhancing material, which may facilitate its removal from unleached polycrystalline diamond table 60*a*. It may also include any material that does not interfere with the HTHP process. For instance template 150 may include a polymer binder that largely decomposes to carbon (C) during the HTHP process. If template 150 includes a material that does interfere with the HTHP process, then it may further include a sink material that absorbs the interfering material.

Acid-labile leach-enhancing material 50 may be grown on or with template 150. It may also be 3-D printed using additive manufacturing on or with template 150.

Rather than using a separate template 150, acid-labile leach-enhancing material 50 may also simply be adhered to or grown on can 20.

Regardless of the template 150 used or whether the acid-labile leach-enhancing material 50 is grown on can 20, after removal and leaching, a leached polycrystalline diamond table 60*b* similar to that of FIG. 1D may be obtained.

Figure 6A:
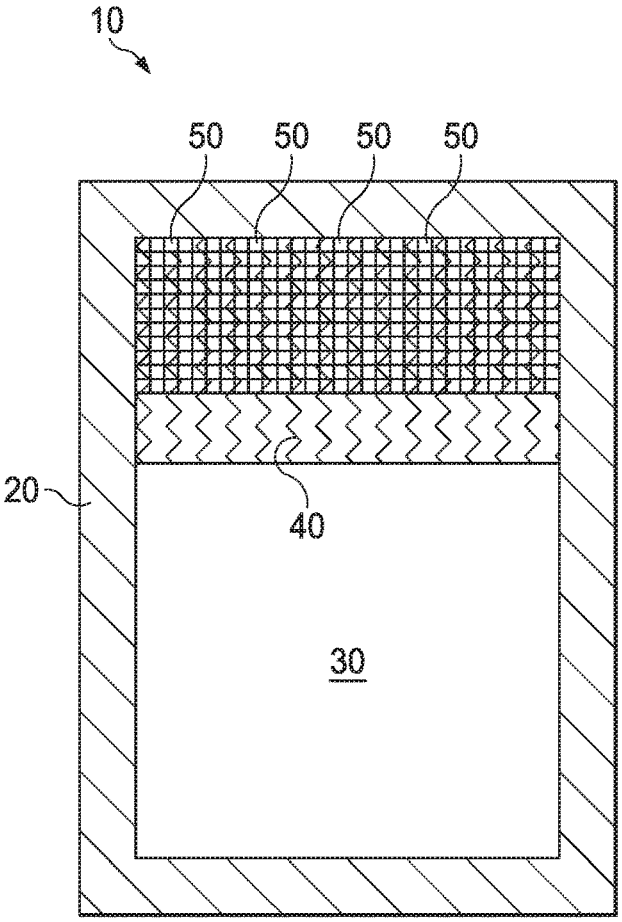
FIG. 6A is a not-to-scale, cross-sectional diagram of a sintering assembly for a PDC cutter with a mesh template of acid-labile leach-enhancing material.
Figure 6B:
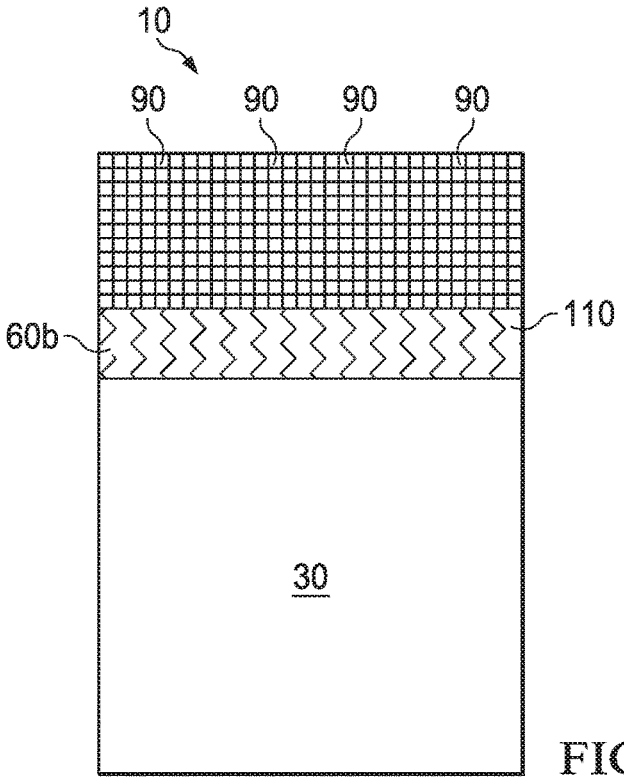
FIG. 6B is a not-to-scale, cross-sectional diagram of a sintered PDC cutter with increased leaching surface area formed by removal of the acid-labile leach-enhancing material shown in FIG. 6A.

Pre-formed structures of acid-labile leach-enhancing material 50 may also be used within diamond grains 40 prior to sintering, resulting in cavities 90 with a particular orientation in polycrystalline diamond table 60. For instance, as shown in FIG. 6A, acid-labile leach-enhancing material 50 may be in the form of a mesh placed in diamond grains 40. This results in a mesh-pattern of cavities in polycrystalline diamond table 90, as shown in FIG. 6B. Although the mesh of FIG. 6 is shown encompassing a large contiguous area and in an orientation perpendicular to the top surface of the polycrystalline diamond table 60, the mesh may be located in smaller contiguous area, or a plurality of meshes may be in a plurality of non-contiguous areas to enhance mechanical stability of the polycrystalline diamond table. In addition, the mesh may be in any orientation with respect to any part of the PDC cutter. For instance, it may be parallel to the top surface of the polycrystalline diamond table 60, or there may be a plurality of meshes in a plurality of orientations.

Although a mesh may be formed having either a micro- or nano-sized diameter of its component strands, nano-sized strands may be more effective.

A mesh of acid-labile leach-enhancing material 50 results in an interconnected grid or a plurality of interconnected grids of cavities 90. However, acid-labile leach-enhancing material 50 may also form an interconnected grid or plurality of interconnected grids of cavities 90 in other manners. For instance, microstructures and nanostructures may be arranged such that they occasionally touch one another, which produces connected cavities 90. This may be particularly effective when a combination of both microstructures 50*a* and nanostructures 50*b* of acid-labile leach-enhancing material are used, as shown in FIG. 3A. This results in an interconnected grid or plurality of interconnected grids of cavities 90, as shown in FIG. 3B, with the microstructure cavities 90*a* oriented with respect to the surface to allow penetration of the leaching agent to a depth within polycrystalline diamond table 60, and at least some nanostructure cavities 90*b* interconnecting at least some microstructure cavities 90*a*.

Multiple ways of orienting or directing acid-labile leach-enhancing material 50 may be employed to produce the same PDC cutter. For instance, elongated nanostructures of acid-labile leach-enhancing material 50 having polarizable terminal moieties, such as those shown in FIG. 8C, may be grown on can 20, then subjected to an electric field to further orient them into diamond grains 40. In another example, microstructures of acid-labile leach-enhancing material 50 may be formed on a template 150 as shown in FIG. 5, and nanostructures of acid-labile leach-enhancing material 50 may be mixed into all or a region of diamond grains 40 so that, as a whole, acid-labile leach-enhancing material 50 contains both microstructures and nanostructures. In still another example, microstructures of acid-labile leach-enhancing material 50*a* may be oriented as shown in FIG. 3A using a magnetic or electric field, but nanostructures of acid-labile leach-enhancing material 50*b* may be mixed into all or a region of diamond grains 40 and may remain that way even when microstructures 50*a* are oriented because nanostructures 50*b* are not responsive to the magnetic or electric field.

Figure 7A:
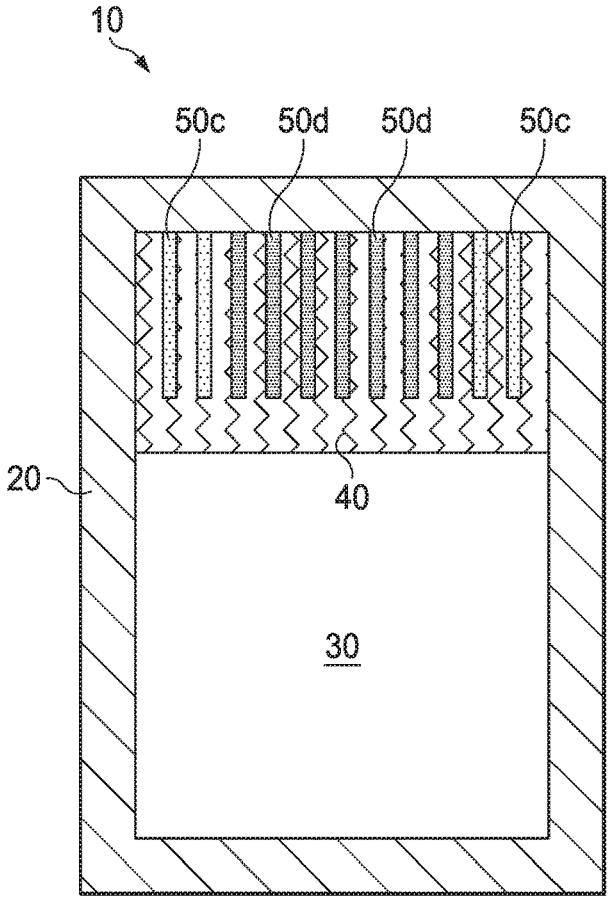
FIG. 7A is a not-to-scale, cross-sectional diagram of a sintering assembly for a PDC cutter with two different acid-labile leach-enhancing materials.
Figure 7B:
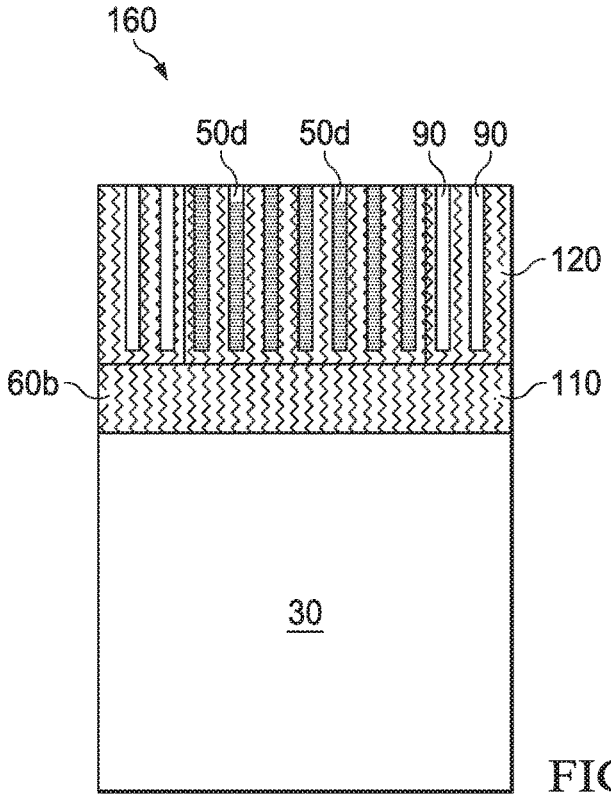
FIG. 7B is a not-to-scale, cross-sectional diagram of a sintered PDC cutter with increase leaching surface area formed by removal of one, but not the other of the two different acid-labile leach-enhancing materials of FIG. 7A.

More than one type of acid-labile leach-enhancing material 50 may be used to form a single PDC cutter. These multiples types of material may be mixed together uniformly or in different proportions, then placed in diamond grains 40. Alternatively, the different types of materials may be localized to different regions of diamond grains 40. For instance, a first, more acid-labile leach-enhancing material 50*c* may be placed around the circumference of the chamber containing diamond grains 40, while a second less acid-labile leach-enhancing material 50*d* may be placed in a central portion of the chamber, as shown in FIG. 7A. A first pre-leaching agent may be used to remove the first acid-labile leach-enhancing material 50*c*, followed by leaching. This results in a PDC cutter 160 as shown in FIG. 7B, with cavities 90 and a leached portion 120 of polycrystalline diamond table 60*b* around the circumference of polycrystalline diamond table and second acid-labile leach-enhancing material 50*d* in a central unleached portion 110 of polycrystalline diamond table 60*b*. PDC cutter may be used in this configuration. However, a different PDC cutter may be readily produced from the same unleached polycrystalline diamond table by simply using a second pre-leaching agent that removes both acid-labile leach-enhancing materials 50*c* and 50*d*, resulting in a PDC cutter 100 as shown in FIG. 1D.

Although the acid-labile leach-enhancing material 50 of FIGS. 1-7 is shown in an elongated shape, it may have any shape. A free-standing elongated microstructure or nanostructure of acid-labile leach-enhancing material is shown in FIG. 8A. Such as structure may also be incorporated into a template, attached to the can, or formed into a mesh or otherwise incorporated into a larger structure.

FIG. 8B is a magnetic material-coated, elongated microstructure or nanostructure of acid-labile leach-enhancing material 50. The structure contains magnetic material coating 170. Although any magnetic material may be used, if it is also a sintering aid, such as Co, Fe, or Ni, then it may be used to orient the acid-labile leach-enhancing material 50 prior to sintering, then at least partially disperse from the acid-labile leach-enhancing material 50 during the HTHP process and act as a sintering aid. Alternatively if the magnetic material is located internally within acid-labile leach-enhancing material 50, then it may be largely sequestered until the pre-leaching agent is applied, such that it does not participate in or interfere with diamond table formation during the HTHP process. A free-standing elongated microstructure or nanostructure of acid-labile leach-enhancing material is shown in FIG. 8B. Such as structure may also be incorporated into a template, attached to the can, or formed into a mesh or otherwise incorporated into a larger structure.

Figure 8C:
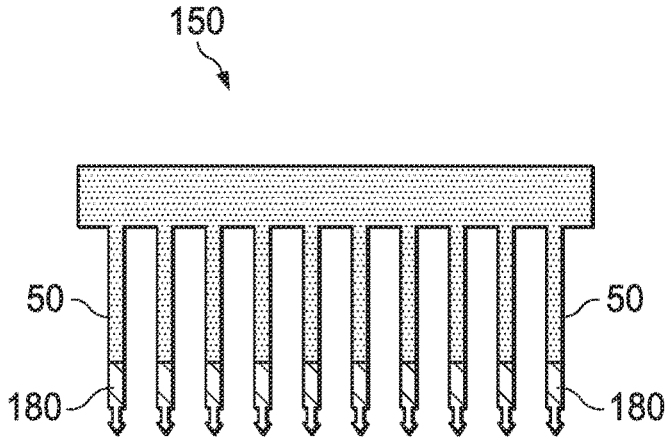
FIG. 8C is a template with an elongated microstructure or nanostructure having a terminal polarizable moiety.

FIG. 8C is a template 150 with an elongated microstructure or nanostructure of acid-labile leach-enhancing material 50 having a terminal polarizable moiety 180. Such an elongated microstructure or nanostructure of acid-labile leach-enhancing material 50 may also be free-standing, formed on or adhered to the can, or otherwise incorporated into a larger structure.

Figure 8D:
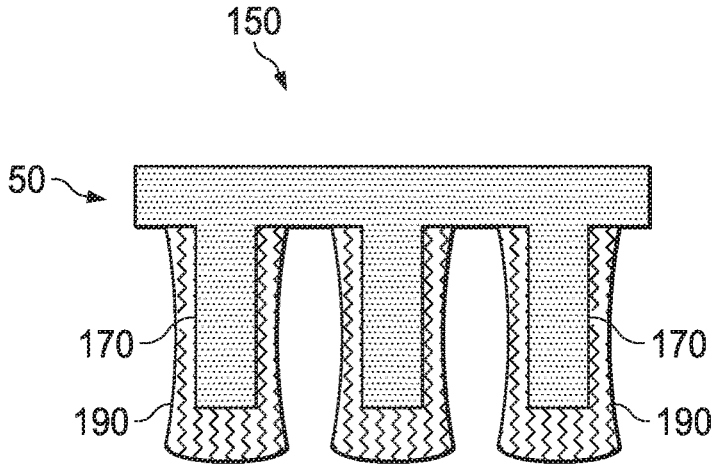
FIG. 8D is a template material with dog-bone microstructures or nanosctructures.

FIG. 8D is a template material 150 with dog-bone microstructures or nanostructures of acid-labile leach-enhancing material 190. These structures have enlarged edges that increase the overall surface area of cavities 90 as compared to cavities formed from more cylindrical structures. Microstructures or nanostructures 190 may be formed by plating the acid-labile leach-enhancing material on template material 150. They may also be formed by plating acid-labile leach-enhancing material on the interior of a can. Pronounced edges and corners result from the higher current density in those locations during a plating process. Although FIG. 8D illustrates a template in which a coating is plated, other variations are possible.

In addition to the sintering assemblies and PDC cutters described in FIGS. 1-7, the present disclosure further provides a method of forming a leached PDC cutter. The method generally uses and results in the structures shown in FIGS. 1A-E.

A substrate and polycrystalline diamond power with acid-labile leach-enhancing material are combined in a can to form a sintering assembly that is subjected to an HTHP process that forms a sintered PDC cutter with an unleached polycrystalline diamond table in which the acid-labile leach-enhancing material remains at least partially intact. The unleached polycrystalline diamond is then placed in a pre-leaching agent that removes at least a portion of the acid-labile leach-enhancing material to form cavities in the polycrystalline diamond table of the sintered PDC cutter. The PDC cutter is then placed in a leaching agent that removes a sintering aid from the polycrystalline diamond table to form a leached polycrystalline diamond table in a leached PDC cutter. The leached polycrystalline diamond table may still have leached and unleached portions. In particular, it may have a leached portion extending to a leaching depth from a surface, and an unleached portion adjacent the substrate. The cavities remain in the leached polycrystalline diamond table after leaching, but they may be backfilled with a backfill material to produce a backfilled PDC cutter.

Figure 9:
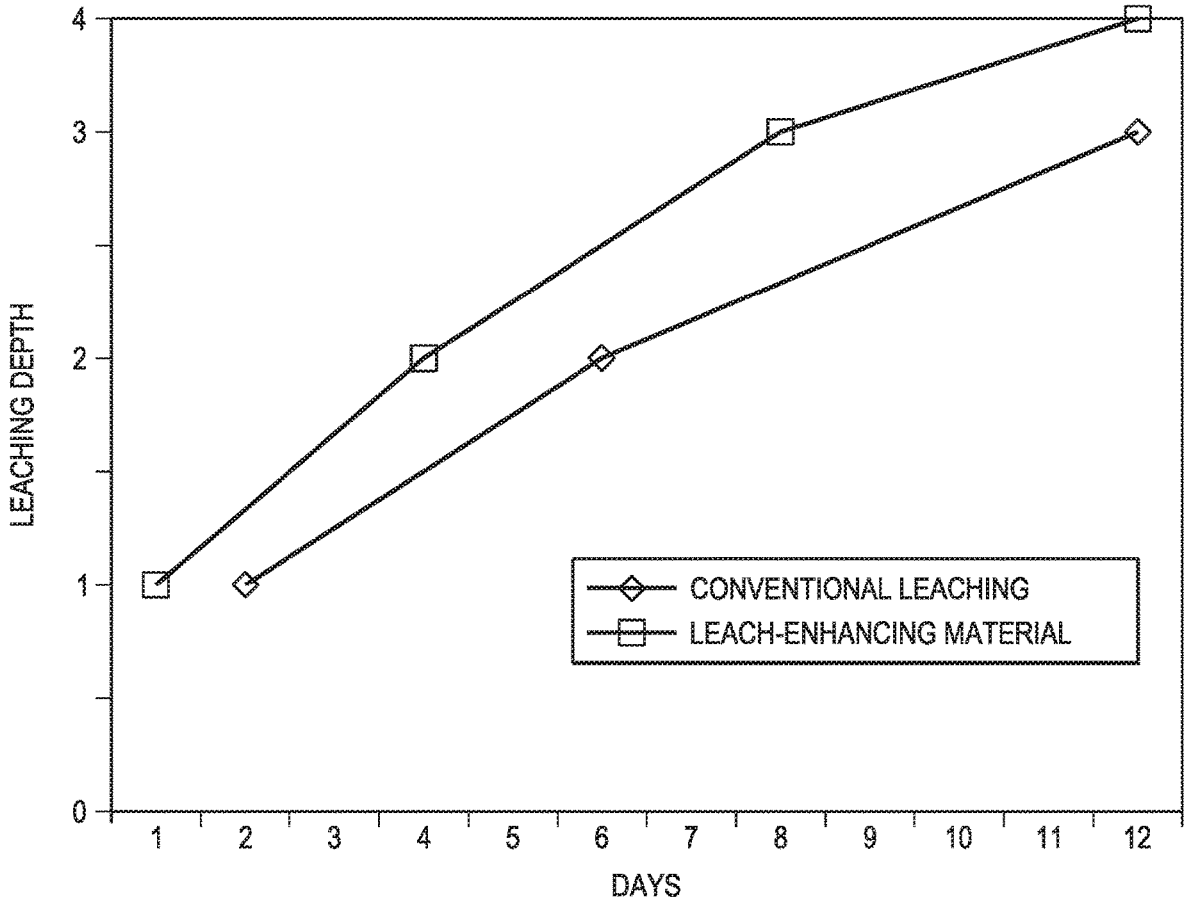
FIG. 9 is a is a conceptual graph of leaching depth of a sintered PDC cutter versus days of leaching using conventional leaching in which the PDC cutter lacks increased leaching surface area formed by removal of an acid-labile leaching boost-material and for leaching using an acid-labile leach-enhancing material in a PDC cutter, as disclosed in the present disclosure, for forming increased leaching surface area formed by removal of an acid-labile leach-enhancing material.

When conventional leaching methods are used, the rate of leaching slows down as leaching progresses to greater depths within the PDC cutter. Thus, the rate of leaching also slows down as total leaching time increases. This effect is illustrated conceptually by the "Conventional Leaching" line in the graph of FIG. 9. Using the structures and methods described herein, the leaching rate may be slowed to a lesser extent as leaching progresses to greater depths and as total time increases. This effect is illustrated conceptually by the "Leach-enhancing Material" line in the graph of FIG. 9. As the graph of FIG. 9 also illustrates, when the structures and methods described herein are used, a given leaching depth may be achieved in less time than with conventional methods. Alternatively, when the structures and methods described herein are used, a greater leaching depth may be achieved in the same time as with conventional methods.

Figure 10:
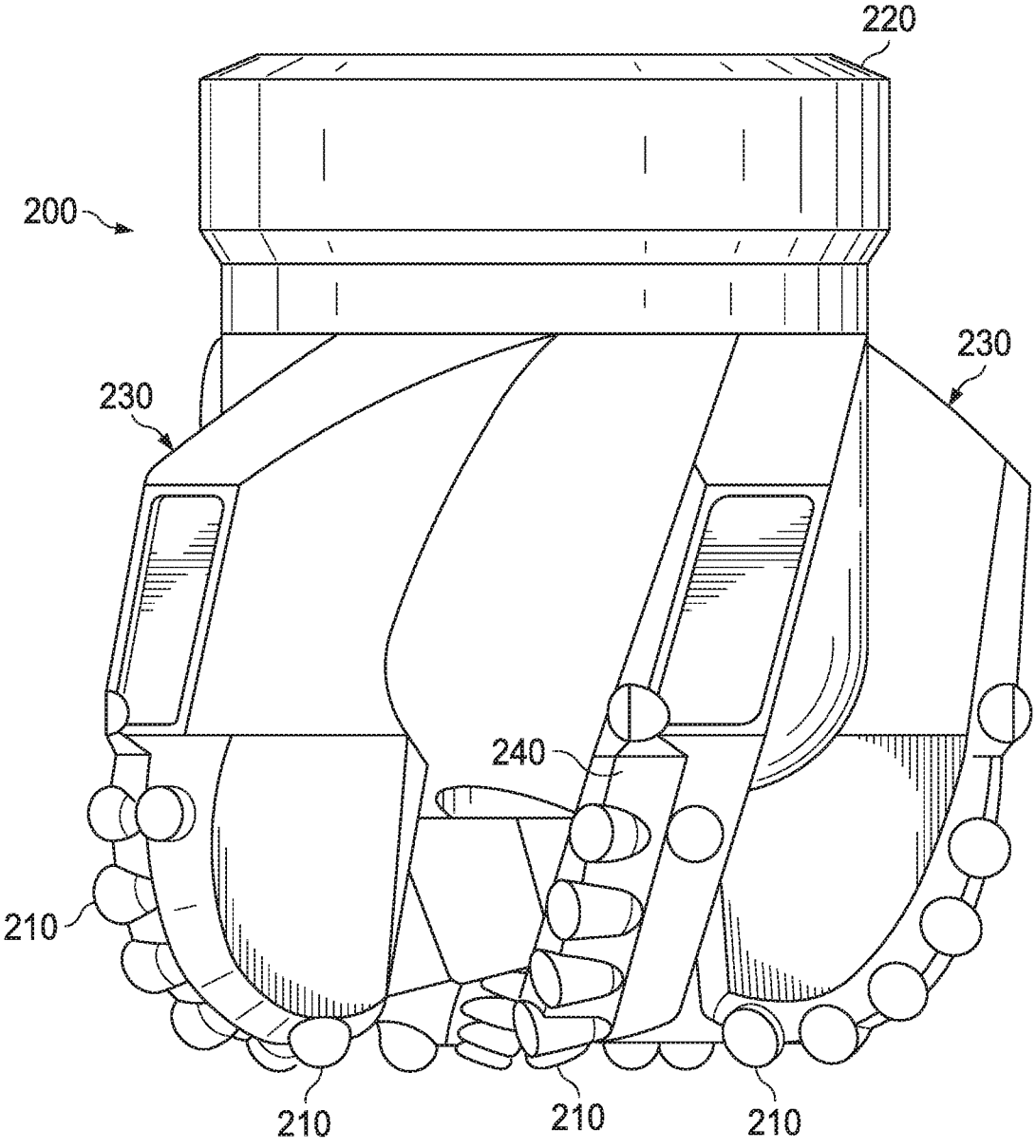
FIG. 10 is an earth-boring drill bit including at least one PDC in the form of a PDC cutter.

A PDC cutter as described herein or formed using the methods described herein may be incorporated into an industrial device, such as an earth-boring drill bit, as illustrated in FIG. 10. FIG. 10 illustrates a fixed cutter drill bit 200 containing a plurality of cutters 210 coupled to drill bit body 220. At least one of cutters 210 may be a leached PDC cutter or a backfilled PDC cutter as described herein.

Bit body 220 may include a plurality of blades 230 extending therefrom. Bit body 220 may be formed from steel, a steel alloy, a matrix material, a metal-matrix composite, or other suitable bit body material desired strength, toughness and machinability. Bit body 220 may be formed to have desired wear and erosion properties. PDC cutters 210 may be located in gage region 240, or in a non-gage region, or both.

Drilling action associated with drill bit 200 may occur as bit body 220 is rotated relative to the bottom of a wellbore in response to rotation of an associated drill string. At least some PDC cutters 210 disposed on associated blades 230 may contact adjacent portions of a downhole formation during drilling. These PDC cutters 210 may be oriented such that their polycrystalline diamond tables contact the formation.

The present disclosure provides an embodiment A relating to an unleached PDC including a substrate and an unleached polycrystalline diamond table including an acid-labile leach-enhancing material and a sintering aid.

The present disclosure provides an embodiment B relating to a leached PDC including a substrate and a leached polycrystalline diamond table including a plurality of microstructure or nanostructure cavities, or a mixture thereof.

The present disclosure provides an embodiment C relating to a drill bit including a bit body and the PDC of embodiment B.

The present disclosure provides an embodiment D relating to a PDC sintering assembly including a substrate, polycrystalline diamond grains, a sintering aid, microstructures or nanostructures or a mixture thereof of acid-labile leach-enhancing material disposed in the polycrystalline diamond grains, and a can in which the substrate, polycrystalline diamond grains, sintering aid and acid-labile leach-enhancing material are disposed.

The present disclosure further provides an embodiment E relating to a method of forming a leached PDC by placing a substrate, polycrystalline diamond grains containing microstructures, nanostructures, or a mixture of both of an acid-labile leach-enhancing material, and a sintering aid in a can to form a sintering assembly, performing an HTHP process on the sintering assembly to produce a sintered PDC with a polycrystalline diamond table containing the acid-labile leaching boost material, removing at least a part of the acid-labile leach-enhancing material from the polycrystalline diamond table, and leaching the polycrystalline diamond table to remove at least a part of the sintering aid.

In addition, embodiments A, B, C, D and E may be used in conjunction with one another and the following additional elements, which may also be combined with one another unless clearly mutually exclusive, and which method elements may be used to obtain devices and which device elements may result from methods: i) the acid-labile leach-enhancing material may be more labile in an acid than the sintering aid; ii) the acid-labile leach-enhancing material may be in the form of a microstructure; ii) the acid-labile leach-enhancing material may be in the form of a nanostructure; iii) the acid-labile leach-enhancing material may be in the form of a mixture of microstructures and nanostructures; iv) the acid-labile leach-enhancing material may be in a dog bone structure; v) the acid-labile leach-enhancing material may be coated with a magnetic material; vi) the acid-labile leach-enhancing material may have a polarizable moiety; vii) the acid-labile leach-enhancing material may be may be part of a template; vii) the acid-labile leach-enhancing material may be part of a mesh; viii) the acid-labile leach-enhancing material may be adhered to the can; the acid-labile leach-enhancing material may be oriented in a pattern in the polycrystalline diamond table; ix) the acid-labile leach-enhancing material may be may include W; x) the acid-labile leach-enhancing material may define a plurality of cavities within the polycrystalline diamond table that increase the leaching surface area of the polycrystalline diamond table after removal of the acid-labile leach-enhancing material; xi) the polycrystalline diamond table may include a plurality of both microstructure and nanostructure cavities; xii) the microstructure or nanostructure cavities, or both, form at least one interconnected grid of cavities; xiii) the microstructure or nanostructure cavities may increase the leaching surface area of the polycrystalline diamond table; ix) the cavities may include a backfill material; x) the leached polycrystalline diamond may include a leached region surrounding the plurality of cavities and an unleached region; xi) the substrate may include the sintering aid; xii)

Although only exemplary embodiments of the invention are specifically described above, it will be appreciated that modifications and variations of these examples are possible without departing from the spirit and intended scope of the invention. For instance, the use of PDCs on other industrial devices may be determined by reference to the drill bit example.

What is claimed is:

1. An unleached polycrystalline diamond compact (PDC) comprising:

a substrate; and an unleached polycrystalline diamond table including an acid-labile leach-enhancing material and a sintering aid, wherein the acid-labile leach-enhancing material is more labile in an acid than the sintering aid and comprises a mixture of both of microstructures having an average largest linear dimension of less than 100 μm and nanostructures having an average largest linear dimension of less than 1000 nm.

2. The PDC of claim 1, wherein the sintering aid comprises cobalt and the acid-labile leach-enhancing material comprises tungsten (W).

3. The PDC of claim 1, wherein the acid-labile leach-enhancing material is configured for removal in the acid to define a plurality of cavities of less than 100 μm within the polycrystalline diamond table that increase the leaching surface area of the polycrystalline diamond table as a result of the removal of the acid-labile leach-enhancing material.

4. An unleached polycrystalline diamond compact (PDC) comprising:

a substrate; and an unleached polycrystalline diamond table including an acid-labile leach-enhancing material and a sintering aid, wherein the acid-labile leach-enhancing material is more labile in an acid than the sintering aid and comprises one or both of microstructures having an average largest linear dimension of less than 100 μm and nanostructures having an average largest linear dimension of less than 1000 nm, wherein one or both of the microstructures and the nanostructures of the acid-labile leach-enhancing material are oriented in a pattern in the polycrystalline diamond table.

5. The PDC of claim 4, wherein the sintering aid comprises cobalt and the acid-labile leach-enhancing material comprises tungsten (W).

6. The PDC of claim 4, wherein the acid-labile leach-enhancing material is in the form of a mixture of both the microstructures and the nanostructures.

7. The PDC of claim 4, wherein the acid-labile leach-enhancing material is configured for removal in the acid to define a plurality of cavities of less than 100 μm within the polycrystalline diamond table that increase the leaching surface area of the polycrystalline diamond table as a result of the removal of the acid-labile leach-enhancing material.

8. A polycrystalline diamond (PDC) sintering assembly comprising:

a substrate;

polycrystalline diamond grains;

a sintering aid;

one or both of microstructures having an average largest linear dimension of less than 100 μm or nanostructures having an average largest linear dimension of less than 1000 nm of an acid-labile leach-enhancing material disposed in the polycrystalline diamond grains, wherein the acid-labile leach-enhancing material is oriented in a pattern in the polycrystalline diamond grains; and a can in which the substrate, polycrystalline diamond grains, sintering aid, and acid-labile leach-enhancing material are disposed.

9. The PDC sintering assembly of claim 8, wherein the substrate comprises the sintering aid.

10. The PDC sintering assembly of claim 8, wherein the acid-labile leach-enhancing material is more labile in an acid than the sintering aid.

11. The PDC sintering assembly of claim 8, wherein the acid-labile leach-enhancing material comprises tungsten (W).

12. A polycrystalline diamond (PDC) sintering assembly comprising:

a substrate;

polycrystalline diamond grains;

a sintering aid;

one or both of microstructures having an average largest linear dimension of less than 100 μm or nanostructures having an average largest linear dimension of less than 1000 nm of an acid-labile leach-enhancing material disposed in the polycrystalline diamond grains, wherein the acid-labile leach-enhancing material has a dog-bone structure; and a can in which the substrate, polycrystalline diamond grains, sintering aid, and acid-labile leach-enhancing material are disposed.

13. The PDC sintering assembly of claim 12, wherein the substrate comprises the sintering aid.

14. The PDC sintering assembly of claim 12, wherein the acid-labile leach-enhancing material is more labile in an acid than the sintering aid.

15. The PDC sintering assembly of claim 12, wherein the acid-labile leach-enhancing material comprises tungsten (W).

16. A polycrystalline diamond (PDC) sintering assembly comprising:

a substrate;

polycrystalline diamond grains;

a sintering aid;

one or both of microstructures having an average largest linear dimension of less than 100 μm or nanostructures having an average largest linear dimension of less than 1000 nm of an acid-labile leach-enhancing material disposed in the polycrystalline diamond grains, wherein the acid-labile leach-enhancing material is in the form of a template or mesh or adhered to the can; and a can in which the substrate, polycrystalline diamond grains, sintering aid, and acid-labile leach-enhancing material are disposed.

17. The PDC sintering assembly of claim 16, wherein the substrate comprises the sintering aid.

18. The PDC sintering assembly of claim 16, wherein the acid-labile leach-enhancing material is more labile in an acid than the sintering aid.

19. The PDC sintering assembly of claim 16, wherein the acid-labile leach-enhancing material comprises tungsten (W).

* * * * *